US005918965A

United States Patent [19]

Ferrada

[11] Patent Number: 5,918,965

[45] Date of Patent: Jul. 6, 1999

[54] BELT-MOUNTED FLASHLIGHT HOLDER

[76] Inventor: Marcelo E. Ferrada, 7840 N. View Point Cir., Tucson, Ariz. 85741

[21] Appl. No.: 08/878,331

[22] Filed: Jun. 18, 1997

[51] Int. Cl.[6] ..... F21L 7/00

[52] U.S. Cl. ..... 362/191; 362/190

[58] Field of Search ..... 362/191, 190, 362/208, 103, 108; 224/674, 250, 930

[56] References Cited

U.S. PATENT DOCUMENTS

| | | | |
|---|---|---|---|
| D. 264,391 | 5/1982 | Schweitzer . | |
| D. 271,160 | 11/1983 | Sherwin . | |
| D. 291,942 | 9/1987 | Green . | |
| D. 293,628 | 1/1988 | Teachey . | |
| D. 328,820 | 8/1992 | Davie . | |
| D. 344,411 | 2/1994 | Henry et al. . | |
| D. 351,480 | 10/1994 | Bamber et al. . | |
| D. 354,677 | 1/1995 | Troyer . | |
| D. 377,118 | 1/1997 | Carbone et al. . | |
| 2,894,119 | 7/1959 | Stenger . | |
| 4,970,631 | 11/1990 | Marshall | 362/191 |
| 5,154,506 | 10/1992 | Leard . | |
| 5,217,294 | 6/1993 | Liston | 224/250 |
| 5,601,356 | 2/1997 | McWilliams . | |
| 5,699,943 | 12/1997 | Shaefer et al. | 362/108 |

*Primary Examiner*—Thomas M. Sember
*Assistant Examiner*—Todd Reed Hopper
*Attorney, Agent, or Firm*—Halvorson & Venable, P.C.; Lance C. Venable

[57] ABSTRACT

A flashlight holder is disclosed herein that comprises a sleeve capable of slideably receiving a belt therethrough, with the sleeve having affixed thereto a means for engaging a flashlight and retaining the flashlight substantially parallel to the belt line. Thus, the present flashlight holder is belt-mounted to provide the user with ready access to the flashlight but positions the flashlight horizontally along the belt line, instead of vertically hanging from the belt line, so that the flashlight does not interfere with one's ability to walk or sit.

8 Claims, 4 Drawing Sheets

BELT-MOUNTED FLASHLIGHT HOLDER

TECHNICAL FIELD

The present invention relates to flashlight holding apparatuses, and more particularly, to a belt-mounted apparatus for retaining a flashlight parallel to the belt line.

BACKGROUND ART

Many different professions require the use of a flashlight for visibility in a dark environment. Examples of persons employing flashlights while on the job include law enforcement officers, inspectors, automobile mechanics, and exterminators. Likewise, persons engaged in various outdoor activities such as camping also frequently require a readily-available flashlight. However, it is inconvenient to manually hold a flashlight for long periods of time because one hand must be dedicated to the flashlight.

A number of apparatuses have been developed to hold a flashlight and to thereby enable one to perform tasks with both hands while having ready access to the flashlight when needed. For example, U.S. Pat. No. 2,894,119, issued to Stenger on Jul. 7, 1959 and entitled "Flashlight Holder", discloses a device of T-shaped construction having a longitudinal section with a substantially square base. Stenger discloses an opening in the base for hanging a flashlight therethrough and slots in the two wings of the longitudinal section for receiving any stationary object therethrough, such as a twig or branch. Therefore, the device disclosed by Stenger allows one to hang a flashlight from a nearby tree; however, the device is not located on one's person and could result in the misplacement of the flashlight. Moreover, the opening in the base of Stenger's device must be correctly sized for a particular flashlight. U.S. Design Pat. No. 354,677, issued to Troyer on Jan. 24, 1995 and entitled "Clip for a Flashlight", discloses an apparatus onto which a flashlight might be mounted that has a clip design for attachment to a thin sheet of material, such as a car visor.

A number of issued patents disclose flashlight holders that enable the storage of a flashlight on one's person. For example, U.S. Design Pat. No. 264,391, issued to Schweitzer on May 18, 1982 and entitled "Combined Headband and Flashlight Holder", discloses a flashlight holder in the form of a headband. However, one might find the weight of a flashlight about one's head to be uncomfortable in the event the flashlight moves about during physical activity. A number of issued patents disclose the storage of flashlights on one's arm. For example, the following issued patents teach wrist-mounted flashlight holders: (1) U.S. Design Pat. No. 344,411, issued to Henry et al. on Feb. 22, 1994 and entitled "Wrist Light Mount"; (2) U.S. Design Pat. No. 328,820, issued to Davie on Aug. 25, 1992 and entitled "Flashlight Holder"; and (3) U.S. Pat. No. 5,601,356, issued to McWilliams on Feb. 11, 1997 and entitled "Flashlight Stand and Wrist Mount System". U.S. Pat. No. 5,154,506, issued to Leard on Oct. 13, 1992 and entitled "Flashlight Armband", discloses a flashlight holder comprising an adjustable elastic strap for encircling the arm and a smaller integral sleeve for retaining the flashlight. The storage of a flashlight on one's arm or wrist, while freeing the hands, may still be inconvenient during activities requiring free use and swing of one's arms without hindrance, particularly for mid-sized to large-sized flashlights.

Several issued patents disclose flashlight holders that are belt-mounted so that the flashlight is readily accessible in a more convenient fashion around one's torso rather than on an appendage. In most cases, the belt-mounted flashlight holder maintains the flashlight in a vertical position that is substantially perpendicular to the belt line—essentially, such designs allow the flashlight to dangle from the belt. However, the vertical orientation of a flashlight at one's torso can be bothersome when in a seated position as well as during locomotive activity due to interference with leg movement. The following four issued patents teach such vertical belt-mounted flashlight holder systems: (1) U.S. Design Pat. No. 271,160, issued to Sherwin on Nov. 1, 1983 and entitled "Flashlight Holder"; (2) U.S. Design Pat. No. 293,628, issued to Teachey on Jan. 12, 1988 and entitled "Belt Mounted Flashlight Holder"; (3) U.S. Design Pat. No. 351,480, issued to Bamber et al. on Oct. 11, 1994 and entitled "Belt Flashlight"; and (4) U.S. Design Pat. No. 377,118, issued to Carbone et al. on Jan. 7, 1997 and entitled "Belt-Attached Flashlight Holder". Incidentally, a flashing light belt is disclosed in U.S. Design Pat. No. 291,942, issued to Green on Sep. 22, 1987, but is not designed to hold a flashlight.

Accordingly, there is a need for flashlight holding apparatus that maintains a flashlight in a readily accessible position about one's torso that neither interferes during locomotive activity nor when assuming a seated position. The apparatus have a simple and sturdy design that is readily adaptable to a variety of sizes and shapes of flashlights and should be readily and inexpensively manufactured from commonly-available parts.

DISCLOSURE OF INVENTION

In accordance with the invention, a flashlight holder is disclosed herein that is belt-mounted to provide the user with ready access to the flashlight but that does not interfere with one's ability to walk or sit. Specifically, the present flashlight holder comprises a sleeve capable of slideably receiving a belt therethrough, with the sleeve having affixed thereto a means for engaging a flashlight and retaining the flashlight substantially parallel to the belt line.

Like other belt-mounted flashlight holders, the present belt-mounted flashlight holder provides the user ready access to a flashlight while freeing his hands for other activities. However, unlike other belt-mounted flashlight holders, the present holder retains a flashlight in a fixed position along the belt line so that the flashlight does not move to and fro in response to the user's locomotive activity, as would a flashlight dangling from the belt. Moreover, by positioning the flashlight horizontally along the belt line, the flashlight is no longer about the user's hip so as to interfere during sitting. The present flashlight holder is contemplated to be particularly useful for those individuals who routinely carry a flashlight and may now retain their flashlights unobtrusively on the belt line instead of dangling therefrom.

The present flashlight holder is a simple and sturdy design that can be made readily adaptable to a variety of sizes and shapes of flashlights. Moreover, it may be manufactured from a variety of commonly-available materials, such as cloth, webbing material, leather, vinyl, plastic, and other flexible materials. The present holder thus overcomes the disadvantages of the above-described apparatuses in a manner that is easily and inexpensively implemented.

BEST MODES FOR CARRYING OUT THE INVENTION

In accordance with the invention, a flashlight holding apparatus is provided that comprises a sleeve capable of slideably receiving a belt therethrough, with the sleeve having affixed thereto a means for engaging a flashlight and retaining the flashlight substantially parallel to the belt line.

Figure 1:
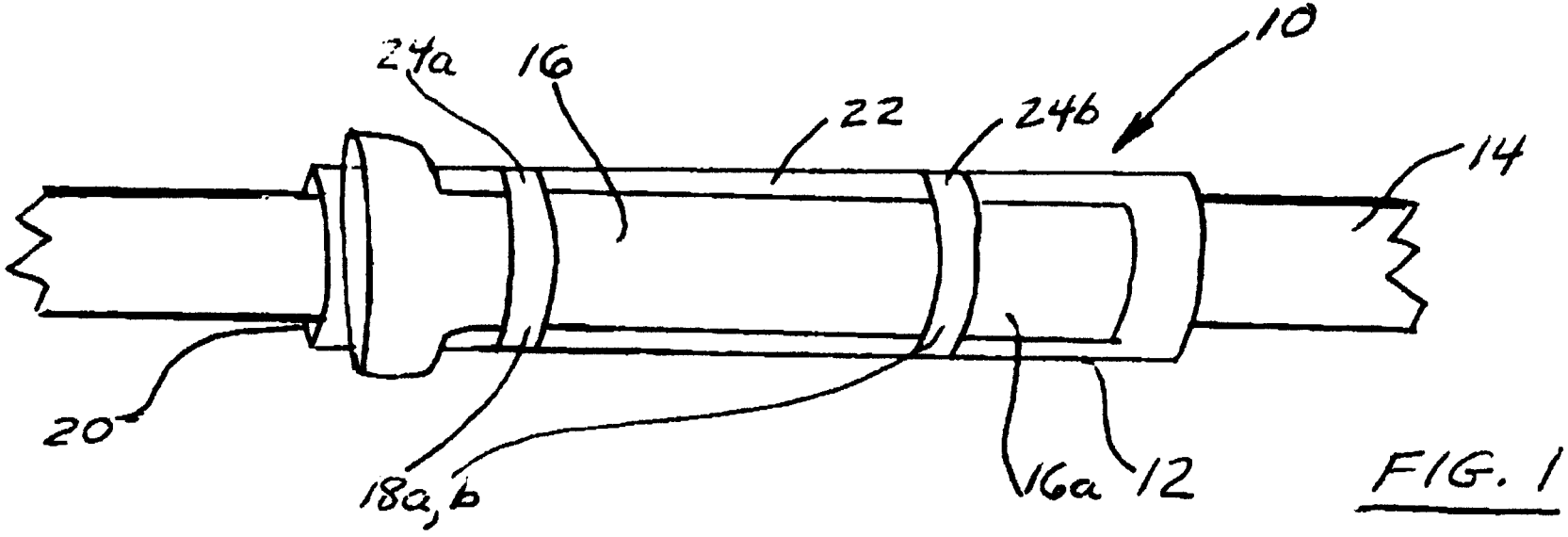
FIG. 1. is a perspective view of a preferred embodiment of the present flashlight holder as it is contemplated for use.

Referring now to the drawings, in which like numbers represent like parts throughout the several views, FIG. 1 depicts a preferred embodiment of the invention as it is contemplated for use. The flashlight holder 10 comprises a sleeve 12 through which a belt 14 can be threaded. In the preferred embodiment, the means for engaging a flashlight 16 comprises two loops 18*a,b* affixed to the sleeve 12.

Figure 1A:
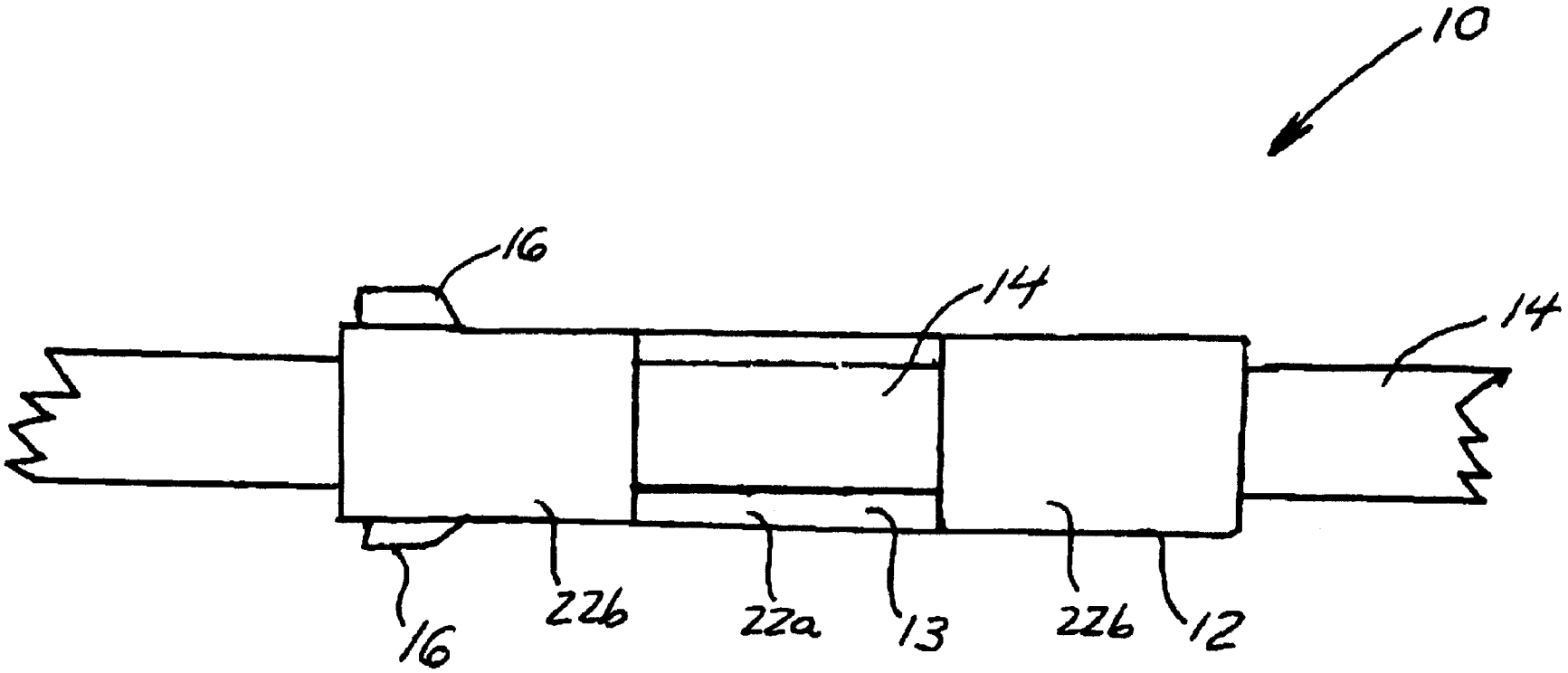
FIG. 1A is a rear elevational review of an embodiment of the present flashlight holder in which the sleeve has an open slot along its backside so that the threaded belt may engage a belt loop.

In the practice of the invention, the sleeve 12 is an elongated member having an opening 20 along its longitudinal axis through which a belt 14 may be threaded. Preferably, the sleeve 12 comprises a solid tube of material, although it is contemplated that any sleeve construction having a longitudinally-oriented opening for a belt might be employed regardless of whether the sleeve's walls 22 are solid or perforated. For example, it is contemplated that the sleeve 12 might have an opening 13 along its back wall 22*b* through which the threaded belt 14 is accessible and through which the front wall 22*a* of the sleeve is visible, as depicted in FIG. 1A. In the embodiment of FIG. 1A, the belt 14 can engage a belt loop (not shown) through opening 13 so that the present flashlight holding apparatus 10 as a whole can be prevented from moving horizontally along the belt line.

The opening 20 of the sleeve 12 should be sufficiently large to accept a belt 14, which typically range from about 0.5 inch to several inches in width, although it is contemplated that a typical belt 14 will range from one to two inches in width. The opening 20 should therefore be at least slightly larger than the contemplated belt width, and the opening 20 should remain substantially constant in width across the longitudinal axis of the sleeve 12.

It is contemplated that the sleeve 12 will comprise a flexible material so that the sleeve 12 conforms to the curvature of the belt 14 as it is worn. Examples of suitably flexible materials that may be employed in the practice of the invention include, but are not limited to, cloth, webbing material, leather, vinyl, and plastic. It is preferred in the practice of the invention that the sleeve 12 will comprise either webbing material, leather or vinyl for a sturdy yet flexible construction.

Figure 2:
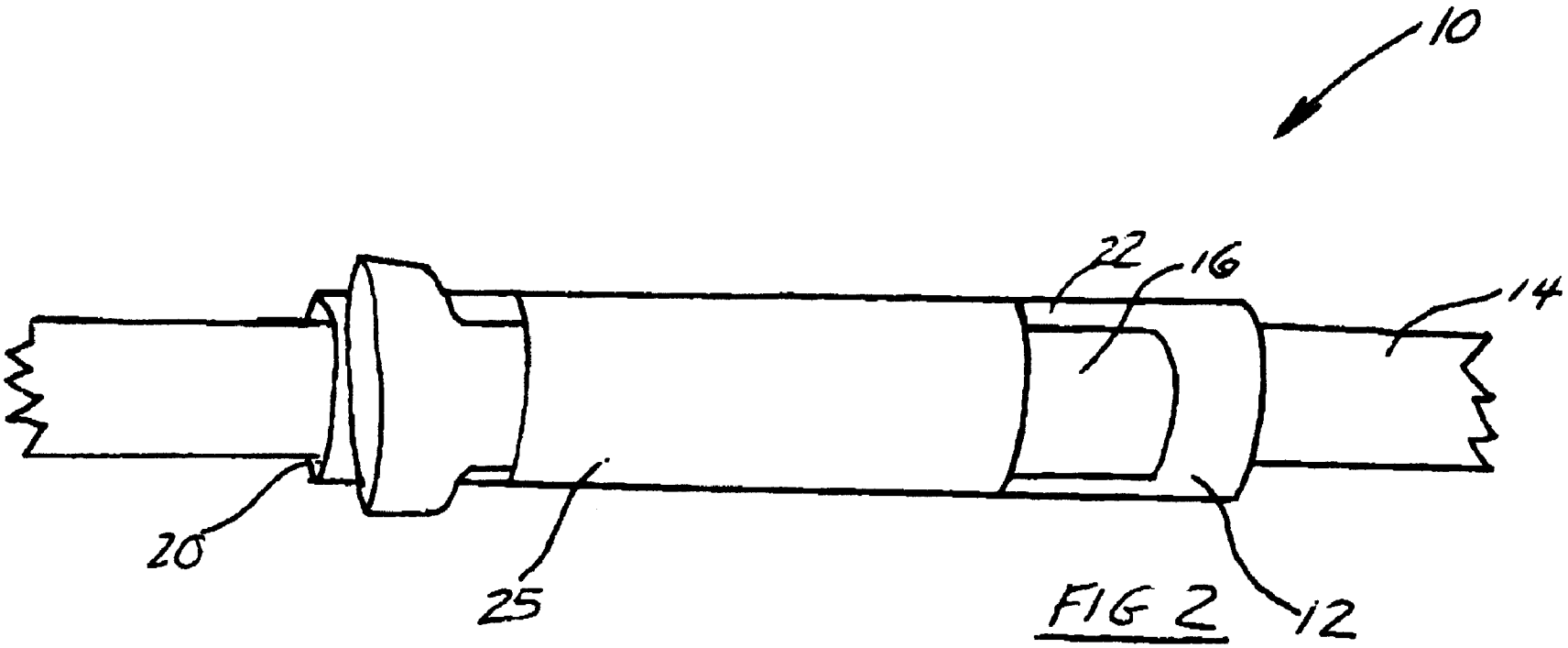
FIG. 2 is a perspective view of an alternative embodiment of the invention in which a single elongated engaging means is employed to retain the flashlight in position.

A flashlight 16 is retained along the sleeve 22 by an engaging means 18 affixed to the sleeve 12. Preferably, the engaging means comprises a plurality of loops 24 affixed to the sleeve 12. As depicted in FIG. 1, the flashlight holder 10 comprises a sleeve 12 with two loops 24*a,b* affixed to the sleeve 12. Alternatively, the flashlight holder 10 might comprise a single loop structure 25 as depicted in FIG. 2.

Figure 3:
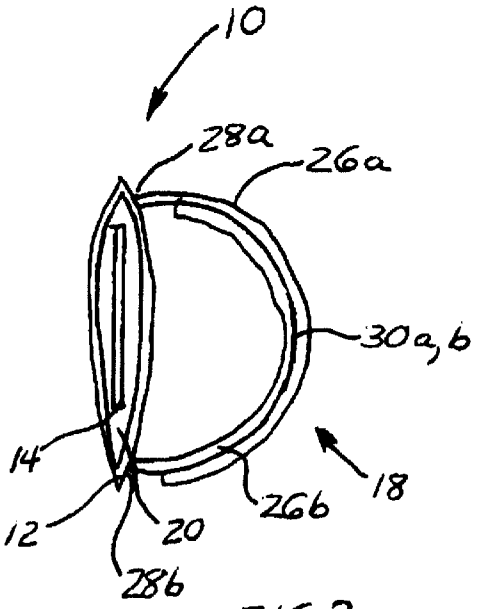
FIG. 3 is a side elevational view of an embodiment of the present flashlight holder in which the flashlight engaging means comprises a pair of fastening straps.

There are various configurations available to achieve a loop structure. For example, FIG. 3 depicts a loop structure that is formed by joining the ends of two straps 26*a,b* with a fastening means. Suitable fastening means include, but are not limited to, snaps (not shown), buttons (not shown), and hook-and-loop fastening systems, commonly known as Velcro™ systems. The fastening means depicted in FIG. 3 is a hook-and-loop fastening system in which each strap 26*a* and 26*b* is attached by a first end 28*a,b* to the sleeve 12 and in which the mating faces 30*a,b* of straps 26*a,b* respectively have adhered thereto a strip of hook-and-loop material that characterizes Velcro™ material. Preferably, a hook-and-loop system is employed in the practice of the invention.

Figure 3A:
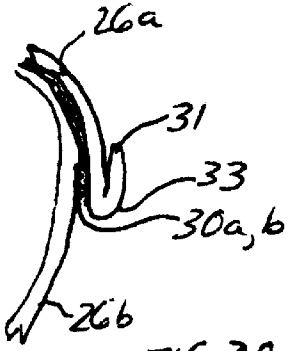
FIG. 3A is an enlarged cut-away view of FIG. 3 showing a hook-and-loop fastener system with the preferred option of thickening the distal end of the strap for ease of handling.

FIG. 3A depicts the preferred embodiment in which the tip of the distal end 31 of the strap 26*a* is folded back on itself and sewn to define a finger grip 33 to facilitate ripping the distal end 31 of the strap free of its hook-and-loop attachment.

It is preferable that the engaging means 18 take the form of a plurality of loops comprised of fastenable opposing straps, as depicted in FIG. 3, such that the user may simply rip the straps 26*a,b* apart at their mated faces 30*a,b* to adjust the size of the loop structure necessary, b to accommodate the flashlight 16 to be retained therein. First-time installation of a flashlight 16 is relatively easy with the configuration of FIG. 3—the user need only position the flashlight 16 along the face of the sleeve 12 and engage the fastening straps 26*a,b* about the flashlight 16 until a proper fit is reached for a secure hold. With the embodiment depicted in FIG. 3, subsequent installations and removals of the flashlight 16 from the apparatus 10 may be accomplished by either ripping the straps 26*a,b* apart or by simply threading and de-threading the flashlight 16 through the loops 24*a,b,* leaving the loop structures intact at their original settings.

Figure 4:
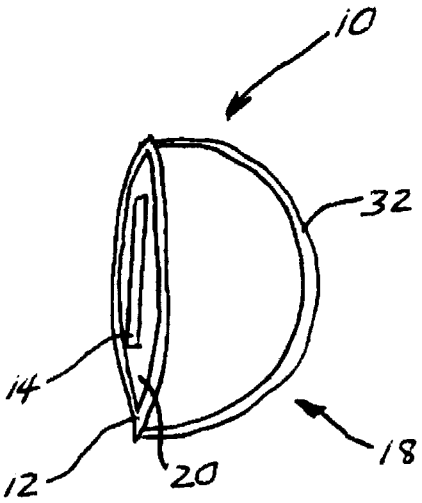
FIG. 4 is a side elevational view of an embodiment of the present flashlight holder in which the flashlight engaging means comprises a simple loop.

If a simple loop system such as depicted in FIG. 4 is employed, the flashlight 16 is engaged by threading the flashlight 16 through the loops 32 leading with the smaller end 16*a* of the flashlight (see FIG. 1). Thus, the solid loop system depicted in FIG. 3 requires the user to thread the flashlight 16 through the loop(s) 32 for installation and to de-thread the flashlight 16 for use.

Figure 5:
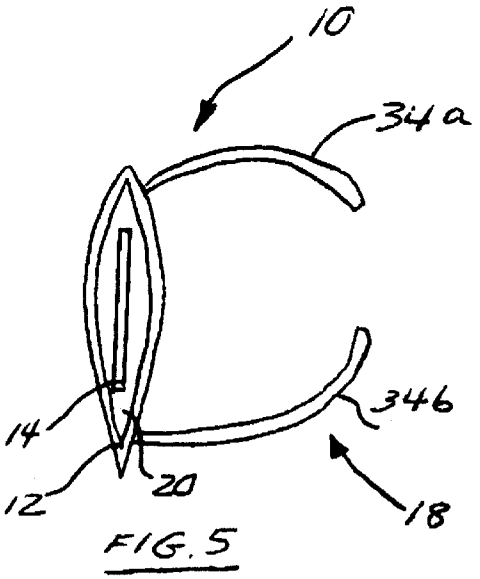
FIG. 5 is a side elevational view of an embodiment of the present flashlight holder in which the flashlight engaging means comprises flexible clips for clipping a flashlight into place alongside the sleeve.

The engaging means 18 can assume other configurations aside from a loop-type system such as depicted in FIGS. 3 and 4, so long as the flashlight is securely retained alongside the sleeve 12. For example, a clip-on configuration as depicted in FIG. 5 might be employed wherein relatively sturdy but somewhat flexible (e.g., plastic) clipping arms 34*a,b* extend from the sleeve 12 to accept a flashlight 16 pushed thereupon. Therefore, whereas the embodiment of FIG. 5 requires the engaging means 18 to comprise a somewhat rigid material, the loop systems depicted in FIGS. 3 and 4 may comprise such flexible materials as cloth, webbing material, leather, and vinyl, among others.

Advantageously, the present flashlight holder 10 can be manufactured to accommodate a wide variety of shapes and sizes of flashlights 16, although it is particularly contemplated that substantially cylindrical flashlights will be accommodated by the present holder 10. In particular, the hook-and-loop fastening system depicted in FIG. 3 enables one to adjust the capacity of the engagement means as necessary to encircle a wide variety of flashlights 16.

The flashlight holder 10 of the present invention therefore offers one the ability to retain a flashlight 16 unobtrusively on one's torso, thereby allowing freedom of movement of the arms and hands, while also retaining the flashlight 16 away from interference with the hips and legs for walking and sitting. It is contemplated that the present flashlight holder 10 will be worn on the belt 14 where it traverses one's back so that the flashlight 16 is completely removed as an obstacle but remains readily accessible.

Thus, there has been disclosed a flashlight holder that is capable of retaining a flashlight in a horizontal position along one's belt line. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. A flashlight holder comprising a sleeve having an opening throughout its longitudinal axis, said sleeve comprises a flexible material, said sleeve capable of slideably receiving a belt therethrough, said sleeve having affixed thereto a means for engaging a flashlight and retaining said flashlight substantially parallel to said belt.

2. The flashlight holder of claim 1 wherein said flexible material is selected from the group consisting of cloth, webbing material, leather, vinyl, and plastic.

3. The flashlight holder of claim 1 wherein said means for engaging a flashlight comprises a single unit of material.

4. The flashlight holder of claim 1 wherein means for engaging a flashlight comprises a pair of straps, each having a first end and a second distal end, each said first end being affixed to said sleeve and said pair of said second distal ends joined to one another by a fastening means to form at least one loop.

5. The flashlight holder of claim 4 wherein said fastening means comprises a hook-and-loop system.

6. The flashlight holder of claim 1 wherein said means for engaging a flashlight is formed of a flexible material, wherein said flexible material is selected from the group consisting of cloth, webbing material, leather, vinyl, and plastic.

7. A flashlight holder comprising a sleeve having an opening throughout its longitudinal axis, said sleeve capable of slideably receiving a belt therethrough, said sleeve having affixed thereto two loops for engaging a flashlight and retaining said flashlight substantially parallel to said belt, said loops each comprising a pair of straps, each strap having a first end and a second distal end, each said first end being affixed to said sleeve and said pair of said second distal ends joined to one another by a fastening means to form said loop.

8. The flashlight holder of claim 7 wherein said fastening means comprises a hook-and-loop system.

* * * * *